US008485912B2

(12) United States Patent
Kim

(10) Patent No.: US 8,485,912 B2
(45) Date of Patent: Jul. 16, 2013

(54) POWERLESS AUTOMATIC TEE UP MACHINE

(76) Inventor: Hyong Jun Kim, Yongin-si (KR)

( * ) Notice: Subject to any disclaimer, the term of this patent is extended or adjusted under 35 U.S.C. 154(b) by 0 days.

(21) Appl. No.: 13/389,158

(22) PCT Filed: Aug. 3, 2010

(86) PCT No.: PCT/KR2010/005102

§ 371 (c)(1),
(2), (4) Date: Feb. 6, 2012

(87) PCT Pub. No.: WO2011/019158

PCT Pub. Date: Feb. 17, 2011

(65) Prior Publication Data

US 2012/0135814 A1 May 31, 2012

(30) Foreign Application Priority Data

Aug. 11, 2009 (KR) ..... 10-2009-0073955

(51) Int. Cl.
*A63B 57/00* (2006.01)

(52) U.S. Cl.
USPC ..... 473/137; 473/132

(58) Field of Classification Search
USPC ..... 473/132–137
See application file for complete search history.

(56) References Cited

U.S. PATENT DOCUMENTS

| | | | | |
|---|---|---|---|---|
| 2,071,356 | A * | 2/1937 | Pagett | 473/137 |
| 3,738,662 | A * | 6/1973 | Hodgin | 473/137 |
| 4,265,453 | A * | 5/1981 | Loof | 473/137 |
| 5,346,222 | A * | 9/1994 | Luther, Sr. | 473/137 |
| 5,464,223 | A * | 11/1995 | Dermott | 473/137 |
| 5,624,325 | A * | 4/1997 | Smith | 473/137 |
| 6,174,243 | B1 * | 1/2001 | Choi | 473/137 |
| 6,682,438 | B2 * | 1/2004 | Lee | 473/137 |

FOREIGN PATENT DOCUMENTS

| | | | |
|---|---|---|---|
| JP | 04-108577 | U | 9/1992 |
| JP | 10-137380 | A | 5/1998 |
| KR | 20-1997-0051018 | U | 9/1997 |
| KR | 20-0316430 | Y1 | 6/2003 |

OTHER PUBLICATIONS

International Search Report, Application No. PCT/KR2010/005102, dated Apr. 26, 2011.
Written Opinion of the International Searching Authority, Application No. PCT/KR2010/005102, dated Apr. 26, 2011.

* cited by examiner

*Primary Examiner* — Steven Wong
(74) *Attorney, Agent, or Firm* — Kile Park Reed & Houtteman PLLC

(57) ABSTRACT

The present invention relates to a powerless automatic tee up machine, which repeats the transporting of the golf balls onto a golf tee through potential energy, a cam curve, a principle of balancer and a link system without using power, and which has a maximally simplified structure to significantly reduce manufacturing costs as compared to conventional machines. For this purpose, the powerless automatic tee up machine of the present invention comprises a main body unit which receives a golf ball and feeds the gold ball through an outlet, an outlet block unit for opening/shutting the outlet, a rotating unit which determines the opening/shutting operation of the outlet block unit, and which rotates in accordance with the presence or absence of the golf ball, and a rotation control unit which controls the motion of the rotating unit in accordance with whether or not the golf ball has been transferred to a golf tee by the rotating unit, thereby enabling the repeated tee up of golf balls without using power and also increasing effectiveness in terms of manufacturing costs due to the simplified structure.

6 Claims, 10 Drawing Sheets

POWERLESS AUTOMATIC TEE UP MACHINE

TECHNICAL FIELD

The present invention relates to a powerless automatic tee up machine, and more particularly, to a powerless automatic tee up machine which repeats the transporting of golf balls onto a golf tee through potential energy, a cam curve, and a link system without using power, and which has a maximally simplified transporting structure to significantly reduce manufacturing costs.

BACKGROUND ART

In general, tee up machines automatically place golf balls on a tee to allow users to repeatedly practice a golf swing. Most conventional tee up machines that use a sensing device such as a sensor with power suffer from space restrictions due to use of power. They may also have high manufacturing cost and maintenance problems in case the sensor fails.

To solve these problems, an example of a conventional powerless tee up machine has been designed to carry a golf ball to a tee through an arm which rotates due to the weight of the golf ball. The conventional tee up machine has to manually position a golf ball on an arm using a pedal or has a complicated structure for controlling the direction in which the arm rotates, thereby resulting in high manufacturing cost. The conventional tee up machine may also generate noise due to rotation of the arm or have difficulties in correctly putting a golf ball on a golf tee.

DETAILED DESCRIPTION OF THE INVENTION

Technical Problem

The present invention provides a powerless automatic tee up machine for repeatedly teeing up golf balls through a simple structure, thereby having low maintenance and manufacturing costs.

The present invention also provides a powerless automatic tee up machine designed to absorb kinetic energy produced while teeing up a ball or use the kinetic energy for sequential arrangement of golf balls.

Technical Solution

According to an aspect of the present invention, there is provided a powerless automatic tee up machine including: a main body unit including a golf ball receptacle that receives a golf ball and sequentially feeds the golf ball through an outlet, a support for supporting the golf ball receptacle, and a plate extending from the support; an outlet block unit that is disposed on the support so as to rotate upward and open or shut an outlet of the golf ball receptacle; a rotating unit including an arm which has a lower portion rotatably fixed to the support and which rotates by the golf ball received from the golf ball receptacle so as to transport the golf ball to a golf tee, a weight disposed on the inside of a distal end of the arm so that the arm rotates toward the outlet without using power, an elevating member disposed on a central portion of the arm so as to rotate the outlet block unit upward, a seating member for seating the golf ball ejected as the outlet block unit rotates upward, and a hinge disposed at the distal end of the arm 310 so that its end rotates only inward; and a rotation control unit including a balancer that moves up or down in equilibrium depending on whether the rotating unit has transported the golf ball to the golf tee, a connection member that keeps the balancer raised and rotates downward when the golf ball sits on the golf tee, a rotary shaft that is coupled to the connection member and rotates in a direction in which the connection member moves, and a support member that is disposed at a distal end of the rotary shaft, is positioned behind the hinge as it rotates by the golf ball placed on the golf tee in such a way as to prevent the rotating unit from rotating, and returns to its original position when the golf ball falls off the golf tee so that the rotating unit having the golf ball laid thereon rotates toward the golf tee.

The golf ball receptacle may include a first guide including an inclined panel having an inlet at one side thereof and a guide rail tapering down so as to guide the incoming golf ball toward the inlet one at a time, and a second guide that makes contact with only the bottom and left and right sides of the golf ball dropping down into the inlet and is sloped downwardly so as to guide the golf ball to the outlet.

The powerless automatic tee up machine may further include a shock transmitter that limits a radius of rotation of the rotating unit for transporting the golf ball to the golf tee and delivers kinetic energy of the rotating unit to the guide rail.

The shock transmitter delivers shocks produced according to the direction in which the rotating unit moves to the golf ball or the guide rail by contacting a top portion of the arm or the weight.

The shock transmitter passes through a side of the golf ball receptacle. The powerless automatic tee up machine may further include a shock absorber that absorbs a shock by contacting the weight of the rotating unit that rotates toward the golf tee and allows the golf ball to rest on the golf tee at a constant height without bouncing. The position of a portion of the shock absorber in contact with the weight is adjustable.

Advantageous Effects

As described above, a powerless automatic tee up machine according to the present invention enables repeated tee up of golf balls without using power through potential energy of a rotating unit produced by weight of a golf ball and a link system between an outlet block unit that opens or shuts an outlet according to a cam curve of an elevating member and a rotation control unit which controls the motion of the rotating unit in accordance with whether a golf ball has been transferred to a golf tee. The powerless automatic tee up machine also has a simple structure and low manufacturing cost, thereby providing high cost effectiveness.

Another advantage of the powerless automatic tee up machine is to include a shock absorber that absorbs kinetic energy of the rotating unit while teeing up a golf ball so that the golf ball is stably transported onto a golf tee and a shock transmitter which delivers the kinetic energy directly or indirectly to the golf ball and prevents bottlenecks in sequential alignment of golf balls.

BEST MODE

Hereinafter, a powerless automatic tee up machine according to an embodiment of the present invention will be described in detail with reference to the attached drawings.

Figure 1:
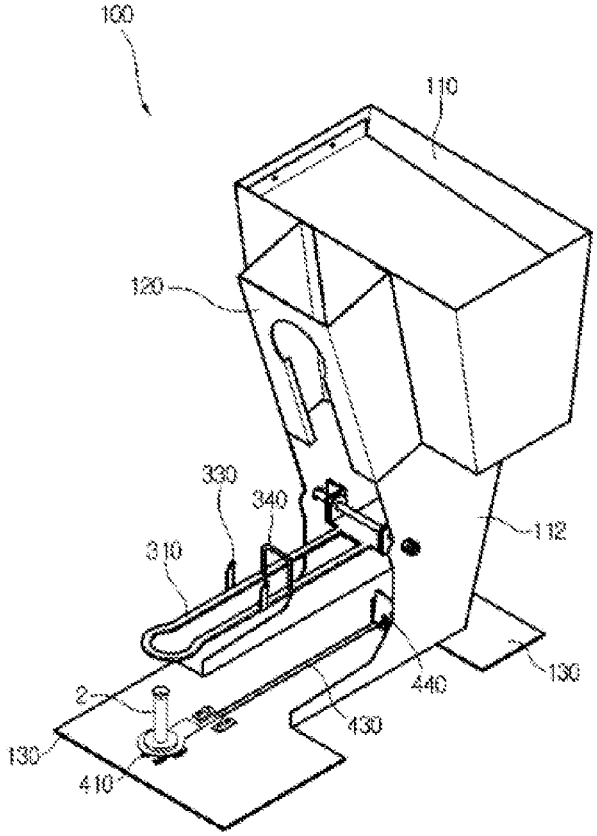
FIG. 1 is a perspective view of a powerless automatic tee up machine according to an embodiment of the present invention.
Figure 2:
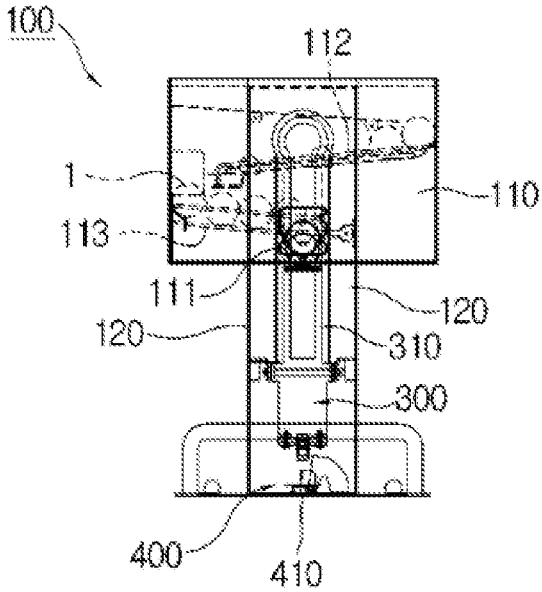
FIG. 2 is a front view of the powerless automatic tee up machine of FIG. 1.
Figure 3:
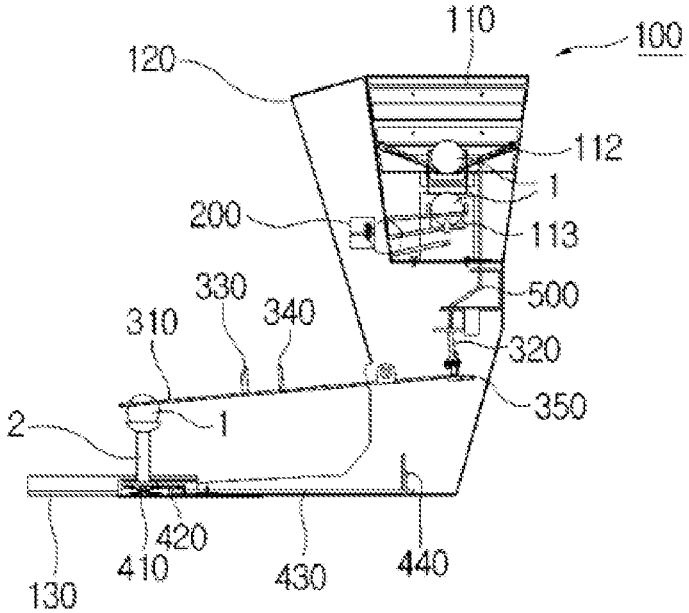
FIG. 3 is a side view of the powerless automatic tee up machine having a shock transmitter according to an embodiment of the present invention.
Figure 4:
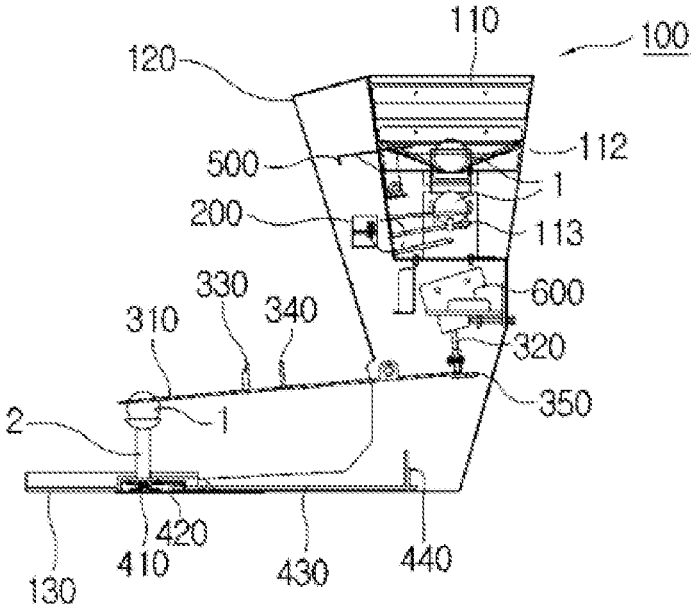
FIG. 4 is a side view of the powerless automatic tee up machine having a shock absorber and a shock transmitter according to an embodiment of the present invention.
Figure 14A:
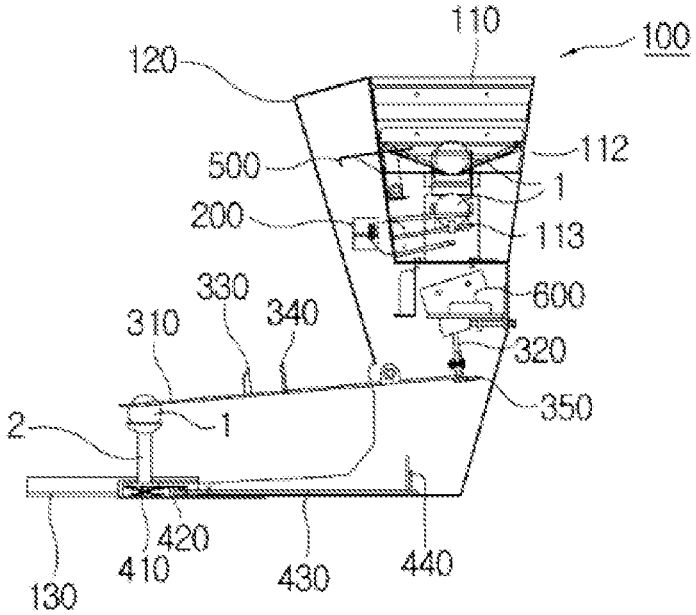
FIGS. 14A through 14C illustrate operation states of the powerless automatic tee up machine according to an embodiment of the present invention.
Figure 14B:
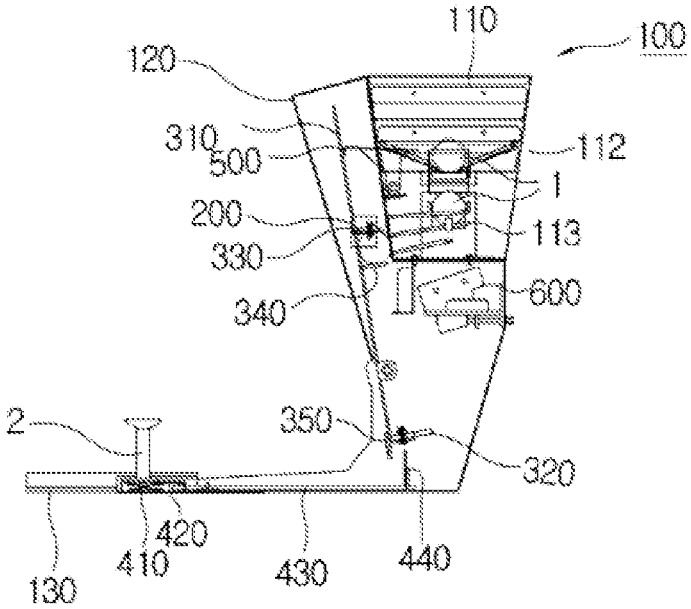
Figure 14C:
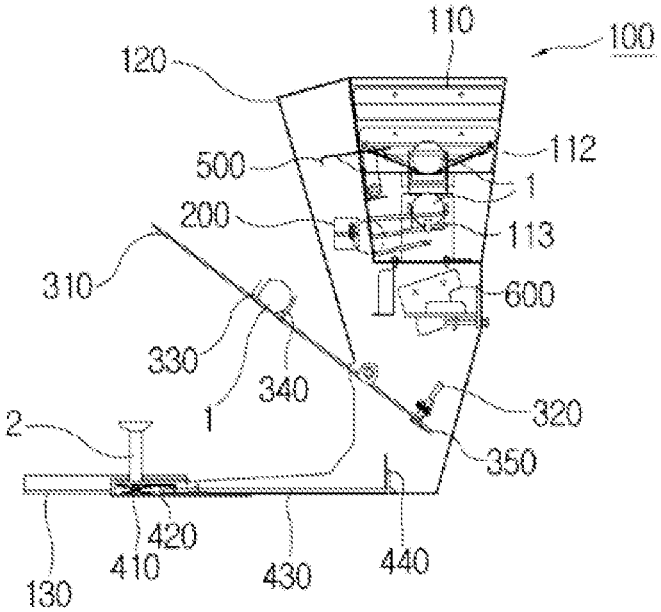

FIG. 1 is a perspective view of a powerless automatic tee up machine according to an embodiment of the present invention. FIG. 2 is a front view of the powerless automatic tee up machine of FIG. 1. FIG. 3 is a side view of the powerless automatic tee up machine having a shock transmitter according to an embodiment of the present invention. FIG. 4 is a side view of the powerless automatic tee up machine having a shock absorber and a shock transmitter according to an embodiment of the present invention. FIGS. 14A through 14C illustrate operation states of the powerless automatic tee up machine according to an embodiment of the present invention.

Referring to FIGS. 1 through 4 and 14A through 14C, the powerless automatic tee up machine according to the present embodiment includes a main body unit 100 which basically accommodates golf balls up to a predetermined height, an outlet block unit 200 that is disposed on the main body unit 100 and determines the state in which a golf ball 1 is ejected, a rotating unit 300 disposed in the main body unit 100 so as to rotate up or down depending on the presence or absence of the golf ball 1, and a rotation control unit 400 that controls the rotating unit 300 to remain adjacent to the main body unit 100 and stationary in the absence of the golf ball 1.

The main body unit 100 includes a golf ball receptacle 110 that receives the golf ball 1 and sequentially feeds the golf ball through an outlet 111, a support 120 provided such that the golf ball receptacle 110 is separated a predetermined height above the ground, and a plate 130 extending from the support 120.

Figure 5A:
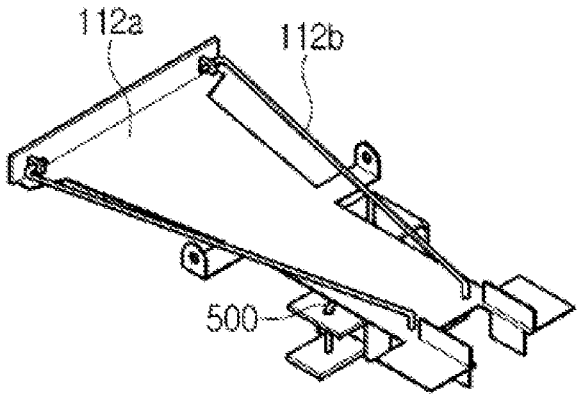
FIGS. 5A and 5B illustrate examples of a first guide and a shock transmitter in the powerless automatic tee up machine, according to an embodiment of the present invention.
Figure 5B:
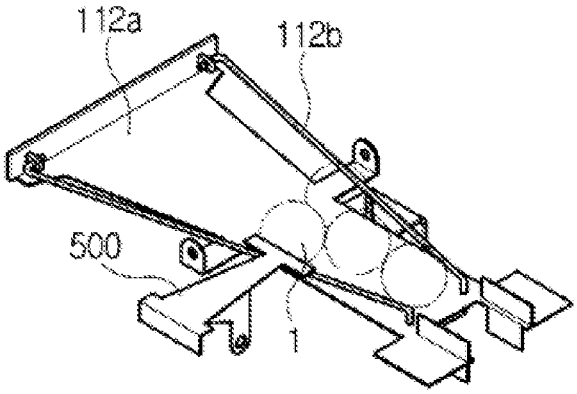
Figure 6:
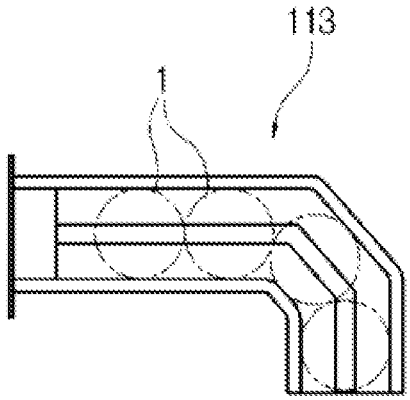
FIG. 6 illustrates a second guide in the powerless automatic tee up machine, according to an embodiment of the present invention.

FIGS. 5A and 5B illustrate examples of a first guide 112 and a shock transmitter 500 in the powerless automatic tee up machine, according to an embodiment of the present invention. FIG. 6 illustrates a second guide 113 in the powerless automatic tee up machine, according to an embodiment of the present invention.

The golf ball receptacle 110 includes the first guide 112 and the second guide 113. The first guide 112 includes an inclined panel 112*a* having a sloped surface to cause the golf ball 1 to roll (toward the outlet 111) and an inlet into which the golf ball 1 rolls down its way and drops, and a guide rail 112*b* tapering down so as to guide the golf ball 1 on the inclined panel 112*a* toward the inlet one at a time. The second guide 113 makes three linear contacts with only the bottom and left and right sides of the golf ball 1 in order to reduce a frictional force and provides a downwardly sloping path so as to sequentially guide the golf ball 1 one at a time before reaching the outlet 111. The golf ball receptacle 110 may further include the shock transmitter 500 that prevents the golf ball 1 from being stuck on the first guide 11, which will be described in more detail below.

The support 120 is provided such that the golf ball receptacle 110 is separated a predetermined distance above the ground. The support 120 also provides a space or coupling surface for installing the outlet block unit 200 and the rotating unit 300. The support 120 is sufficiently high so as to eject the golf ball 1 from the golf ball receptacle 110 through the outlet 111 and convey the golf ball 1 to a golf tee 2.

The plate 130 extends from a bottom of the support 120 in the same direction as the outlet 111. The plate 130 supports the golf ball receptacle 110 and the support 120 to stably stand upright and erect and provide a space for horizontally mounting the rotation control unit 400 thereon.

Figure 7:
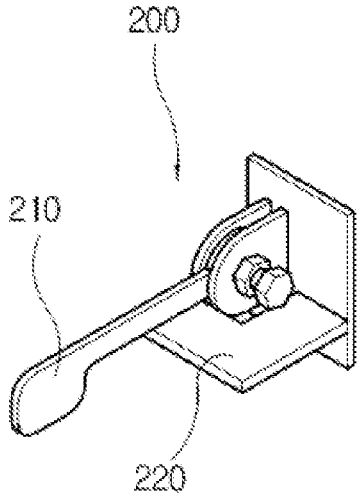
FIG. 7 illustrates an outlet block unit in the powerless automatic tee up machine, according to an embodiment of the present invention.

FIG. 7 illustrates the outlet block unit 200 in the powerless automatic tee up machine, according to an embodiment of the present invention.

Referring to FIG. 7, the outlet block unit 200 opens/shuts the outlet 111 so as to determine whether to eject the golf ball 1 and can rotate upward due to an elevating member 330 that is described in more detail below. The outlet block unit 200 may include a rotation member 210 that is rotatably pin fixed to the support 120 in front of the outlet 111 and an anti-rotation member 220 that prevents the rotation member 210 from moving downward.

Figure 8:
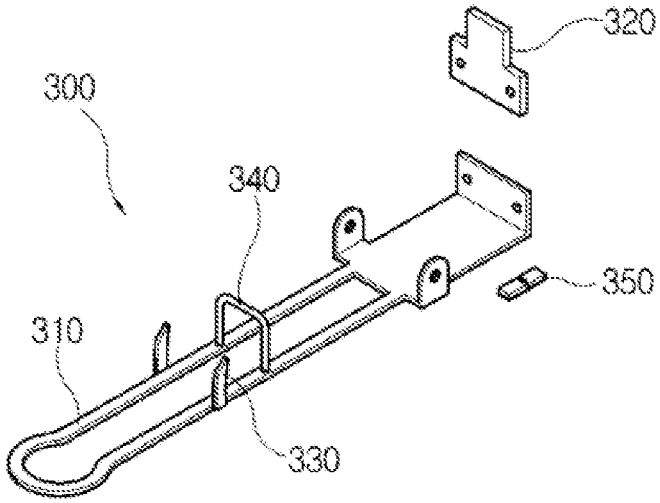
FIG. 8 illustrates a rotating unit in the powerless automatic tee up machine, according to an embodiment of the present invention.

FIG. 8 illustrates the rotating unit 300 in the powerless automatic tee up machine of FIG. 1, according to an embodiment of the present invention.

The rotating unit 300 rotates the outlet block unit 200 upward so that the golf ball 1 is ejected from the golf ball receptacle 110. As an upper end of the rotating unit 300 rotates toward the ground due to the weight of the golf ball, the golf ball 1 rolls down onto the golf tee 2 and the rotating unit 300 rotates back toward the outlet 111. The rotating unit 300 continues to perform the same process without using power. To achieve this, the rotating unit 300 includes an arm 310 which has a lower portion rotatably fixed to the support 120 and which rotates due to the weight of the golf ball 1 received from the golf ball receptacle 110 so as to transport the golf ball 1 to the golf tee 2, a weight 320 disposed on the inside of the lower portion of the arm 310 so that the arm 310 rotates toward the outlet 111 without using power, an elevating member 330 disposed on a central portion of the arm 310 so as to rotate the outlet block unit 200 upward, a seating member 340 for seating the golf ball 1 ejected as the outlet block unit 200 rotates upward, and a hinge 350 disposed on the outside of the lower portion of the arm 310 so that its end rotates inward.

The arm 310 has a throughhole, the diameter of which is longer than that of the golf ball 1, at an upper end, a long hole connecting with the throughhole along a longitudinal direction so that the golf ball 1 may roll stably toward the throughhole, and a rib shaft-coupled to the support 120 at its lower portion. Thus, when the golf ball 1 is placed on the seating member 340 and the arm 310 rotates toward the ground, the golf ball 1 rolls along the long hole and drops downward through the throughhole.

The weight 320 allows the arm 310 to rotate back toward the golf ball receptacle 110 without using power after the arm 310 has rotated down toward the ground. The weight 320 is appropriately heavy so as to rotate the arm 310 down toward the ground when the golf ball 1 is positioned on the seating member 340, and to rotate the arm 310 back toward the golf ball receptacle 110 when the golf ball 1 falls off the arm 310. For example, the weight 320 may be detachably bolt-coupled to a bent L-shaped end of the arm 310.

The elevating member 330 lifts the outlet block unit 200 so that the golf ball 1 is ejected from the outlet 111. When the arm 310 rotates toward the outlet 111, the elevating member 330 produces a cam curve to cause the outlet block unit 200 to open, so that the golf ball 1 is ejected from the outlet 111. On the other hand, when the arm 310 rotates toward the ground, the outlet 111 is shut due to the unladen weight of the rotation member 330 so that the golf ball 1 is not ejected from the outlet 111. In this case, the elevating member 330 may be disposed on either side of the arm 310 so as to allow the golf ball 1 to smoothly travel to the ground along the long hole of the arm 310.

The seating member 340 is provided to stably position the golf ball 1 that is ejected from the outlet 111 when the outlet block unit 200 is rotated upward by the elevating member 330. That is, the golf ball 1 makes contact with an L-shaped support surface formed by the arm 310 and the seating member 340 (as it passes through the seating member 340).

The hinge 350 cooperates with the rotation control unit 400 (to be described below) so as to prevent the rotating unit 300 from rotating toward the ground when the golf ball 1 is positioned on the seating member 340 until the golf ball 1 is removed from the golf tee 2.

The rotation control unit 400 includes a balancer 410, a connection member 420, a rotary shaft 430, and a support member 440. The balancer 410 is disposed below the rotation control unit 400 and moves up or down in equilibrium depending on whether the rotating unit 300 has transported the golf ball 1 to the golf tee 2. The connection member 420 keeps the balancer 410 raised when the golf ball 1 does not sit on the golf tee 2 and rotates downward when the golf ball 1 sits on the golf tee 2. The rotary shaft 430 is coupled to the connection member 420 and rotates in a direction in which the connection member 420 moves. The support member 440 is disposed at a distal end of the rotary shaft 430 and is positioned behind the hinge 350 as it is rotated when the golf ball 1 placed on the golf tee 2 so as to prevent the rotating unit 300 from rotating further. When the golf ball 1 falls off the golf tee 2, the support member 440 returns to its original position so that the rotating unit 300 having the golf ball 1 laid thereon rotates toward the golf tee 2.

Figure 9A:
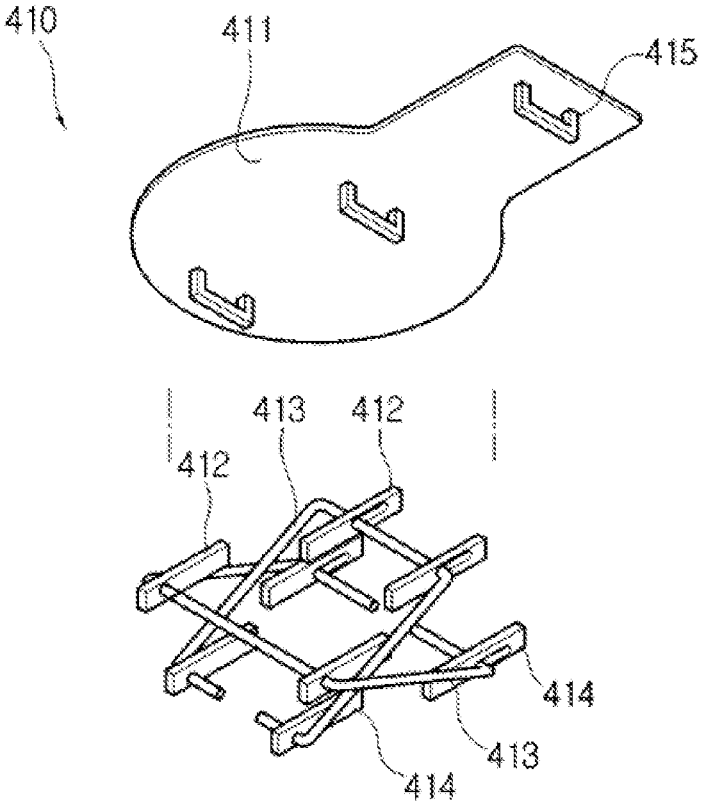
FIGS. 9A and 9B illustrate a balancer in the powerless automatic tee up machine, according to an embodiment of the present invention.
Figure 9B:
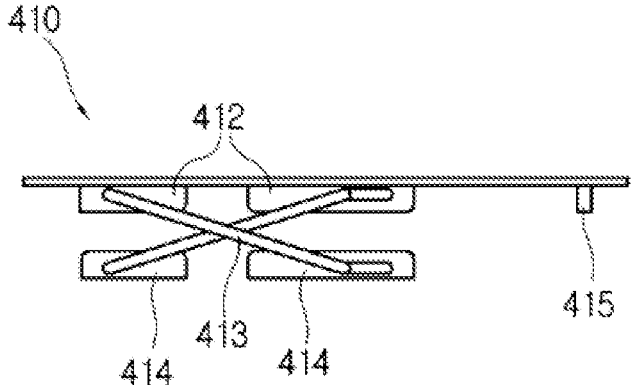

FIGS. 9A and 9B illustrate the balancer 410 in the powerless automatic tee up machine, according to an embodiment of the present invention.

The balancer 410 includes a horizontal panel 411 on which the golf tee 2 is positioned, a pair of opposing first clamping ribs 412 disposed on a bottom surface of the horizontal panel 411, a balancing member 413 that is detachably coupled to the pair of first clamping ribs 412 in a diagonal direction and allows the horizontal panel 411 to move up and down, and a pair of second clamping ribs 414 that are disposed on the plate 130 and fix the balancing member 413. The balancer 410 having the above-described structure moves up or down in equilibrium within a range of movement of the balancing member 413 and is combined with the connection member 420 so as to limit the movement of the rotating unit 300 under control of the support member 440. In this case, the connection member 420 may be simply welded to the balancer 410 or be detachably secured to pass through one or more clamping ribs 415 on the bottom surface of the horizontal panel 411.

Figure 10:
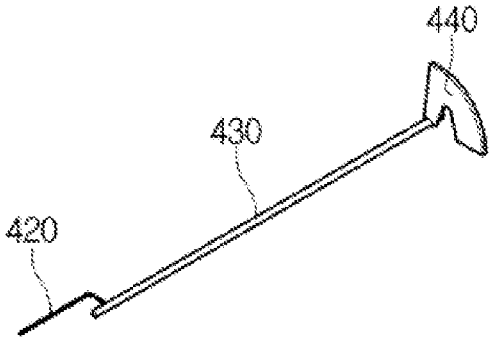
FIG. 10 illustrates a connection structure for connecting a connection member, a rotary shaft, and a support member in the powerless automatic tee up machine, according to an embodiment of the present invention.

FIG. 10 illustrates a connection structure for connecting the connection member 420, the rotary shaft 430, and the support member 440 in the powerless automatic tee up machine, according to an embodiment of the present invention.

When the golf ball 1 is not placed on the golf tee 2, the connection member 420 keeps the balancer 410 raised according to the connection structure for connecting the rotary shaft 430 and the support member 440. Conversely, when the golf ball 1 is placed on the golf tee 2, the balancer 410 is lowered, and simultaneously the connection member 420 rotates in one direction and is coupled to the rotary shaft 430 so as to control the movement of the rotating unit 300.

The rotary shaft 430 has one end coupled to the connection member 420, the other end fixed to the support member 440, and the remaining portion rotatably fixed to the plate 130 and robustly supported. Thus, the rotary shaft 420 rotates in the same direction that the connection member 420 rotates.

Figure 11:
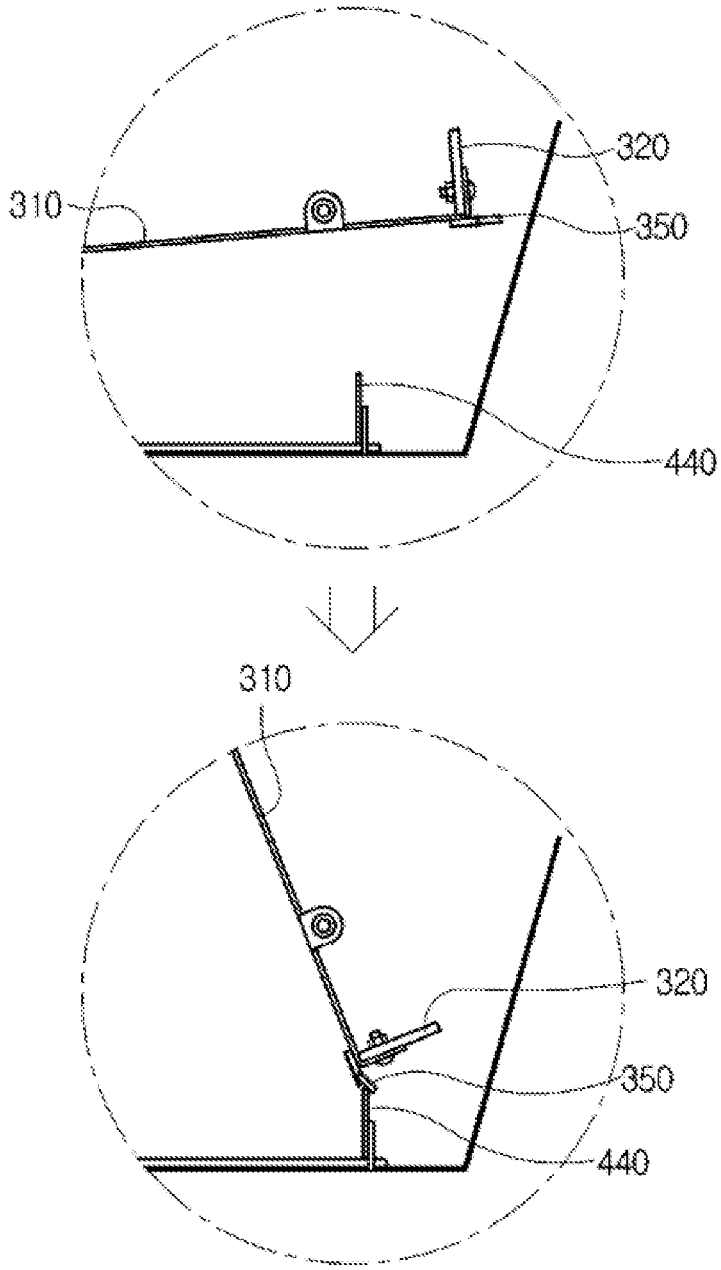
FIG. 11 illustrates an operation between a hinge and a support member in a powerless automatic tee up machine, according to an embodiment of the present invention.

FIG. 11 illustrates the relationship between the operation of the hinge 350 and the support member 440 in the powerless automatic tee up machine, according to an embodiment of the present invention.

When the golf ball 1 is not placed on the golf tee 2, the support member 440 cooperates with the rotary shaft 430 and the connection member 420 so as to keep the balancer 410 in an elevated position due to greater weight on the outside. When the golf ball 1 is placed on the golf tee 2, the support member 440 rotates toward the hinge 350 so as to prevent the rotating unit 300 from rotating toward the golf tee 2. Because a portion of the hinge 350 rotates only inward, the rotating unit 300 maintains the state in which the golf ball 1 is ejected using the arrangement between the hinge 350 and the support member 440 when the golf ball 1 is placed on the golf tee 2. When the golf ball 1 is removed from the golf tee 2, the support member 440 returns to its original position so that the rotating unit 300 transports the golf ball 1 to the golf tee 2.

Because a distance between opposing guide rails 112*b* of the first guide 112 decreases downward, the golf ball 1 may not be smoothly delivered to the second guide 113 due to bottlenecks. Thus, to solve this problem, the powerless automatic tee up machine according to the present embodiment further includes the shock transmitter 500 that limits a radius of rotation of the rotating unit 300 for transporting the golf ball 1 to the golf tee 2 and delivers kinetic energy of the rotating unit 300 to the guide rail 112*b*. The first guide 112 may be shaft fixed or bolted to the golf ball receptacle 110 so as to be agitated by shocks delivered by the shock transmitter 500.

Figure 12:
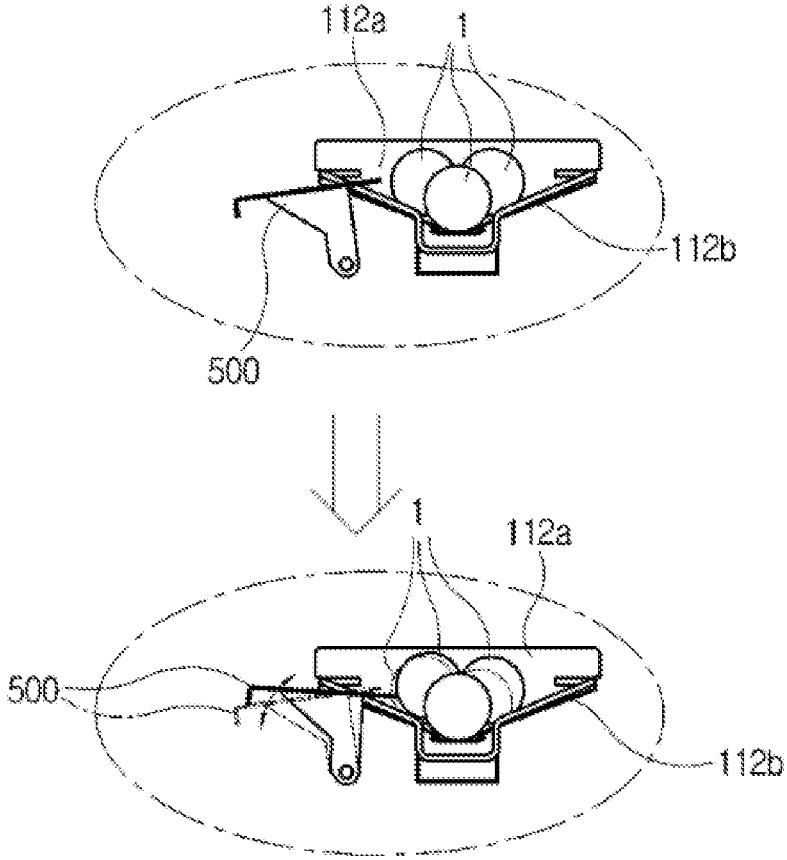
FIG. 12 illustrates the operating principle of a shock transmitter in the powerless automatic tee up machine, according to an embodiment of the present invention.
Figure 13:
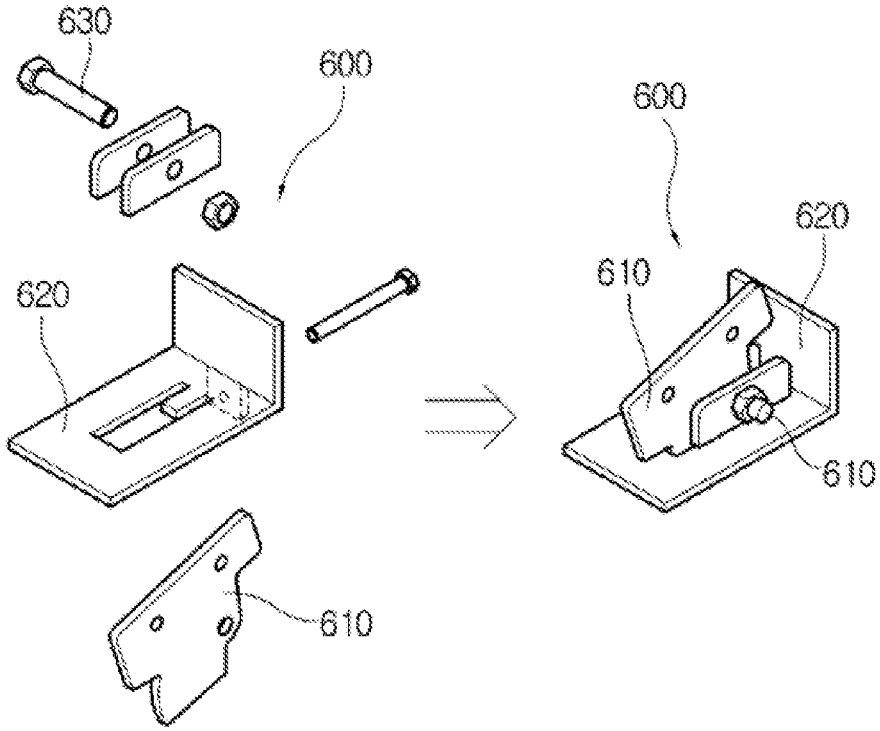
FIG. 13 illustrates a shock absorber in the powerless automatic tee up machine, according to an embodiment of the present invention.

FIG. 12 illustrates the operating principle of the shock transmitter 500 in the powerless automatic tee up machine, according to an embodiment of the present invention. FIG. 13 illustrates a shock absorber 600 in the powerless automatic tee up machine, according to an embodiment of the present invention.

The shock transmitter 500 may have two structures to deliver shocks produced according to the direction in which the rotating unit 300 moves to the golf ball 1 by contacting a top portion of the arm 310 or the weight 320. As shown in the drawings, when the top portion of the arm 310 is directed toward the inlet 111, a portion of the shock transmitter 500 may pass through a side of the golf ball receptacle 110 and apply a shock to the guide rail 112*b* or directly to the golf ball 1 that is stuck due to bottlenecks. In this case, the shock transmitter 500 may have a spring at a distal end or may be shaft-coupled (to the golf ball receptacle 110) so that it moves back to its original position due to the weight after the golf ball 1 is hit off the golf tee 2. In another structure, in order to limit the movement of the weight 320 when the arm 310 rotates toward the golf tee 2, one end of the shock transmitter 500 passes through a bottom surface of the golf ball receptacle 110 and is coupled to the guide rail 112*b* while the other end thereof contacts the weight 320.

When the shock transmitter 500 is used, the powerless automatic tee up machine according to the present embodiment may further include the shock absorber 600 that absorbs a shock by contacting the weight 320 of the rotating unit 300 that rotates toward the golf tee 2 and allows the golf ball 1 to rest on the golf tee 2 at a constant height without bouncing. The shock absorber 600 may also adjust the position of its portion in contact with the weight 320, thereby allowing precise placement of the golf ball 1 on golf tees having different heights. Referring to FIG. 13, the shock absorber 600 for adjusting its position includes a contact portion 610 which contacts the weight 320 and rotates within a predetermined range in order to absorb shocks, a fastening member 620 fixed to the inside of the support 120, and a shaft bolt 630. In order to adjust the position, the contact portion 610 may be shaft fixed to the fastening member 620 at different positions by inserting the shaft bolt 630. That is, the position of the contact portion 610 may be adjusted depending on the position at which the shaft bolt 630 is engaged with a nut. Alternatively, the contact portion 610 may be raised or lowered by varying the length of an adjustment bolt passing through the support 120.

The invention claimed is:

1. A powerless automatic tee up machine comprising:

a main body unit including a golf ball receptacle that receives a golf ball and sequentially feeds the golf ball through an outlet, a support for supporting the golf ball receptacle, and a plate extending from the support;

an outlet block unit that is disposed on the support so as to rotate upward and open or shut an outlet of the golf ball receptacle;

a rotating unit including an arm that has a lower portion rotatably fixed to the support and that rotates by the golf ball received from the golf ball receptacle so as to transport the golf ball to a golf tee, a weight disposed on the inside of a distal end of the arm so that the arm rotates toward the outlet without using power, an elevating member disposed on a central portion of the arm so as to rotate upward the outlet block unit, a seating member for seating the golf ball ejected as the outlet block unit rotates upward, and a hinge disposed at the distal end of the arm so that its end rotates only inward; and a rotation control unit including a balancer that moves up or down in equilibrium depending on whether the rotating unit has transported the golf ball to the golf tee, a connection member that keeps the balancer raised and rotates downward when the golf ball sits on the golf tee, a rotary shaft that is coupled to the connection member and rotates in a direction in which the connection member moves, and a support member that is disposed at a distal end of the rotary shaft, is positioned behind the hinge as it rotates by the golf ball placed on the golf tee in such a way as to prevent the rotating unit from rotating, and returns to its original position when the golf ball falls off the golf tee so that the rotating unit having the golf ball laid thereon rotates toward the golf tee.

2. The machine of claim 1, wherein the golf ball receptacle comprises a first guide including an inclined panel having an inlet at one side thereof and a guide rail tapering down so as to guide the incoming golf ball toward the inlet one at a time, and a second guide that makes contact with only the bottom and left and right sides of the golf ball dropping down into the inlet and is sloped downwardly so as to guide the golf ball to the outlet.

3. The machine of claim 2, further comprising a shock transmitter that limits a radius of rotation of the rotating unit for transporting the golf ball to the golf tee and delivers kinetic energy of the rotating unit to the guide rail.

4. The machine of claim 3, wherein the shock transmitter delivers shocks produced according to the direction in which the rotating unit moves to the golf ball or the guide rail by contacting a top portion of the arm or the weight.

5. The machine of claim 4, wherein the shock transmitter passes through a side of the golf ball receptacle, further comprising a shock absorber that absorbs a shock by contacting the weight of the rotating unit that rotates toward the golf tee and allows the golf ball to rest on the golf tee at a constant height without bouncing.

6. The machine of claim 5, wherein the position of a portion of the shock absorber in contact with the weight is adjustable.

* * * * *